US005452059A

United States Patent [19]

Sekiya

[11] Patent Number: 5,452,059

[45] Date of Patent: Sep. 19, 1995

[54] IMAGE FORMING APPARATUS WHICH STORES COUNTED VALUE IN DIFFERENT MEMORIES DEPENDING ON CONDITION OF COVER

[75] Inventor: Makoto Sekiya, Toyokawa, Japan

[73] Assignee: Minolta Camera Kabushiki Kaisha, Osaka, Japan

[21] Appl. No.: 105,861

[22] Filed: Aug. 11, 1993

[30] Foreign Application Priority Data

Aug. 27, 1992 [JP] Japan ..... 4-228489

[51] Int. Cl.[6] ..... G03G 15/00

[52] U.S. Cl. ..... 355/210; 355/200

[58] Field of Search ..... 355/200, 210, 211, 260, 355/308, 309, 208

[56] References Cited

U.S. PATENT DOCUMENTS

| | | | |
|---|---|---|---|
| 4,774,544 | 9/1988 | Tsuchiya et al. | 355/311 |
| 4,851,875 | 7/1989 | Tanimoto | 355/245 |
| 4,961,088 | 10/1990 | Gilliland et al. | 355/206 |
| 5,066,978 | 11/1991 | Watarai | 355/206 |
| 5,206,685 | 4/1993 | Hara et al. | 355/206 |
| 5,208,631 | 5/1993 | Jacobs et al. | 355/204 |
| 5,253,020 | 10/1993 | Matsushita et al. | 355/260 |
| 5,272,503 | 12/1993 | LeSueur et al. | 355/208 |

FOREIGN PATENT DOCUMENTS

| | | |
|---|---|---|
| 58-195854 | 11/1983 | Japan . |
| 59-93466 | 5/1984 | Japan . |
| 0227166 | 10/1987 | Japan . |
| 0128379 | 5/1988 | Japan . |
| 0059681 | 3/1991 | Japan . |
| 0371965 | 12/1992 | Japan . |

*Primary Examiner*—Robert Beatty

*Attorney, Agent, or Firm*—Willian Brinks Hofer Gilson & Lione

[57] ABSTRACT

When a front cover of a body of a printer is opened, a count value in a system RAM included in a printer body control processor is recorded in a counter in an $E^2$-PROM included in a process cartridge through a system bus and an input/output port. On the other hand, when the front cover of the printer body is closed, a count value of the $E^2$PROM is recorded in the counter in the system RAM. Even in the case where a main switch is turned off, electric power from a receptacle is supplied to each control circuit through a transformer.

9 Claims, 13 Drawing Sheets

IMAGE FORMING APPARATUS WHICH STORES COUNTED VALUE IN DIFFERENT MEMORIES DEPENDING ON CONDITION OF COVER

BACKGROUND OF THE INVENTION

1. Field of the Invention

The present invention relates to image forming apparatuses, and more particularly, to an image forming apparatus determining a time of exchange of units based on the condition (the number of uses) of the unit used in image formation.

2. Description of the Related Art

In order to sense the number of uses (lifetime) of consumable units constituting an image forming apparatus such as a copying apparatus and a laser beam printer, conventionally known is a consumable unit (eg. a process cartridge) having a non-volatile memory contained therein such as a non-volatile RAM and $E^2$PROM (Electrically Erasable and Programmable ROM) (refer to Japanese Patent Laying-Open No. 58-195854).

In such an image forming apparatus, a central processing unit (hereinafter referred to as "CPU", which also carries out other processings) on the side of a body of the apparatus accesses a non-volatile memory in each consumable unit for every printing to count up a counter in the non-volatile memory. Then, by reading out a count value in the non-volatile memory as required and indicating the count value on a display panel, the number of uses of each consumable unit can be known from the non-volatile memory contained in the unit.

Such a structure makes it possible to detect precisely the number of uses even for a used unit which is mounted to the body of the apparatus after being used once, whereby it is possible to grasp a time of exchange of units.

However, when the CPU accesses a non-volatile memory, a heavy load is applied to the CPU. Therefore, access to a non-volatile memory for every printing decreases the processing efficiency of the CPU.

When an $E^2$PROM is used as a non-volatile memory, in particular, the CPU must access the $E^2$PROM by serial transmission. Therefore, the above-described problem is significant. Moreover, there are also problems as in the following. More specifically, there is a limitation in the number of accesses in an $E^2$PROM, and an $E^2$PROM having a higher upper limit value of the number of accesses is more expensive. Therefore, in order to access the $E^2$PROM for every printing, it is necessary to use an $E^2$PROM having an upper limit value of the number of accesses at least higher than the number of use limit of the consumable unit. As a result, an inexpensive $E^2$PROM cannot be used.

SUMMARY OF THE INVENTION

One object of the present invention is to reduce a load of a CPU controlling an image forming operation in an image forming apparatus.

Another object of the present invention is to reduce a product cost of a cartridge provided detachably from a body in an image forming apparatus.

A still another object of the present invention is to reduce a frequency of uses of a non-volatile memory used in a cartridge provided detachably from a body in an image forming apparatus.

In order to achieve the above objects, the image forming apparatus according to the present invention includes a cartridge holding a plurality of elements cooperating with each other to form an image and provided detachably with respect to the body of the apparatus, a non-volatile memory, a counter counting the number of image formation of the plurality of elements, writing means for writing a count value of the counter to the non-volatile memory, and control means for controlling the writing means so that the count value is written in the non-volatile memory in response to generation of a predetermined state in a mean cycle longer than a mean cycle in which the plurality of elements carry out image forming operations.

Since the count value is written in the non-volatile memory in response to generation of a predetermined state in the image forming apparatus structured as described above, a load of the CPU is reduced, and a frequency of operations of the non-volatile memory is decreased.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
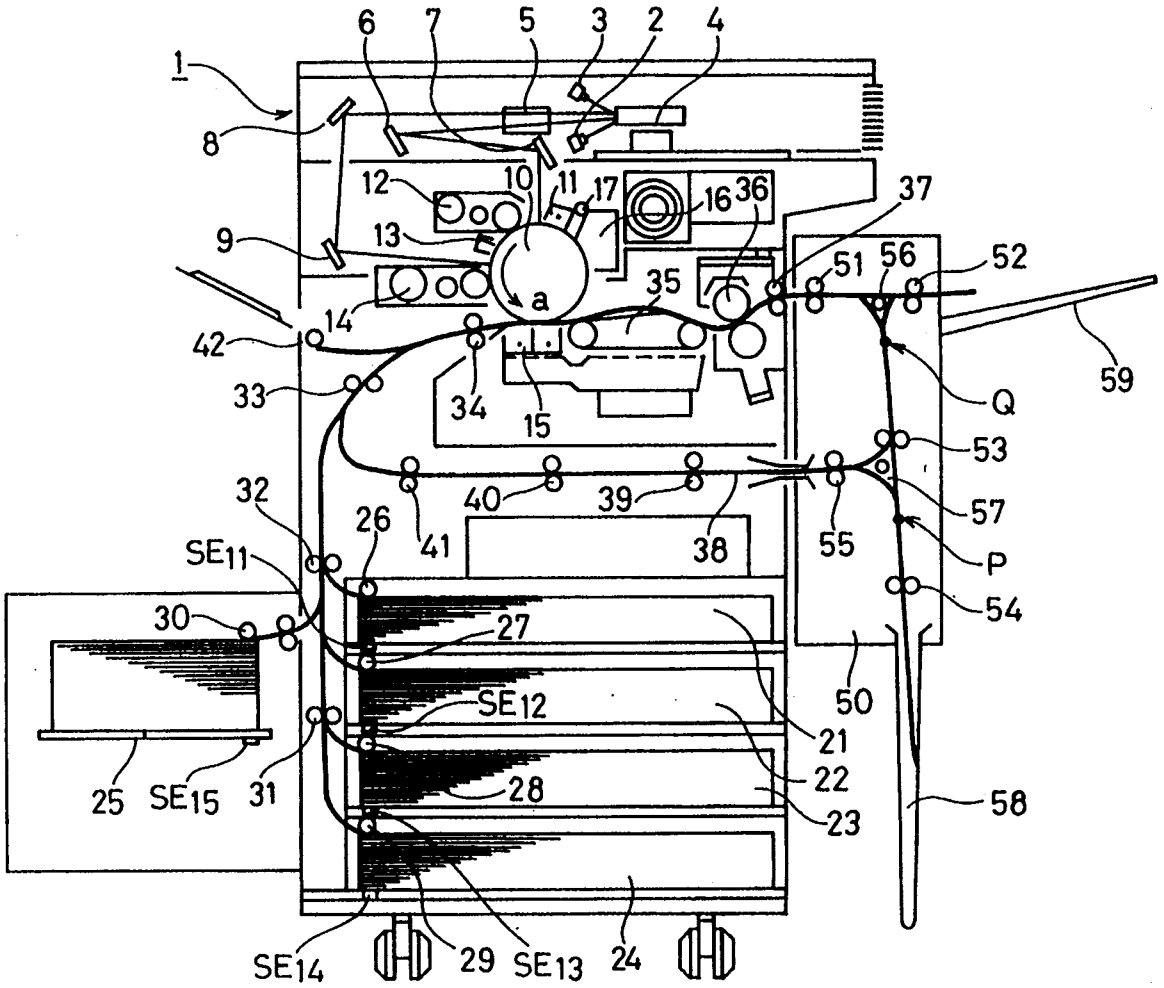
FIG. 1 is a cross sectional view showing a structure of a laser printer according to a first embodiment of the present invention.

FIG. 1 is a cross sectional view of the body of the laser printer according to the first embodiment of the present invention.

A printer body 1 is structured as a cabinet integrated front loading cassette type. A photoreceptor drum 10 is installed in an approximately center portion of printer body 1 rotatably in the direction of an arrow a. Around the photoreceptor drum, provided are a first corona charger 11, a magnetic brush type first developing device 12, a second corona charger 13, a magnetic brush type second developing device 14, a transfer and copy paper separation charger 15, a remaining toner cleaning device 16, a remaining electric charge eraser lamp 17 and the like. Based on image data, beams are emitted from a first laser element 2 and a second laser element 3. Respective beams have their directions of emission controlled by a laser beam scanning system 4 as first exposure light and second exposure light. The first exposure light and the second exposure light have respective luminous flux controlled by an $f\theta$ lens 5. The first exposure light is reflected by reflection mirrors 6, 7 to expose photoreceptor drum 10 immediately after a first corona processing. The second exposure light is reflected by reflection mirrors 8, 9 to expose photoreceptor drum 10 immediately after a second corona processing. Since the print processing by these elements is well known, description thereof will not be repeated.

Four stages of automatic paper feed cassettes 21, 22, 23, 24 are provided at a lower portion of printer body 1. An elevator system automatic paper feed unit 25 as an option is provided on the side of the cabinet. The size and amount of paper sheets placed in each cassette and the paper feed unit are detected by each of sensors SE11 to SE15. A paper sheet is selectively fed one by one by each of paper feed rollers 26 to 30 from each of cassettes and the paper feed unit. In the figure, the thick line shows a paper feed path. A paper sheet from cassettes of first and second stages and the automatic paper feed unit is transported to a timing roller 34 by feed rollers 32, 33 to be held therein. A paper sheet from cassettes of third and fourth stages and automatic paper feed unit 25 is transported to timing roller 34 by feed rollers 30, 31, 32, 33 to be held therein. A paper sheet fed in a manual feed mode is transported to timing roller 34 by a paper feed roller 42 to be held therein. A paper sheet fed by each cassette is fed into a transfer unit in synchronism with an image formed on photoreceptor drum 10. The paper sheet on which a toner image is transferred is transported to a fixing device 36 by a transport belt 35. After toner is heated and fixed here, the paper sheet is discharged outside the body through a discharger roller 37 to be introduced into a paper reversal unit 50.

Paper reversal unit 50 has both a function of feeding a paper sheet to a paper refeed path 38 constituted of rollers 39, 40, 41 and the like and a function selectively processing a face up discharge (non-reversal mode) directly feeding a paper sheet to a paper discharge tray 59 and a face down discharge (reversal mode) reversing the front and back surfaces of a paper sheet, in order to carry out a duplex copy for copying an image on the back surface of a paper sheet having the front surface on which an image has already been copied or a composite copy for copying images on the same surface of a paper sheet by superimposing one image on another.

In order to achieve the above-described functions, paper reversal unit 50 includes a receive roller 51, a feed roller 52, normal/reverse rotation switching rollers 53, 54, and a switch back path 58. Switching claws 56, 57 can switch a rotational angle between two angles by a solenoid, not shown.

In the non-reversal mode, a paper sheet is guided on the upper face of switching claw 56 from receive roller 51 to be fed out from feed roller 52 to paper tray 59 in a face up state. In the reversal mode, a paper sheet is guided on the left side face of switching claw 56 from receive roller 51. A front edge of the paper sheet reaches switch back path 58 by normal rotation of roller 54. When a rear edge of the paper sheet reaches a reversal point P, rollers 53, 54 are switched to reverse rotation.

With positions of the front and rear edges reversed, the paper sheet is guided on the right side face of switching claw 56 to be fed out from feed roller 52 to paper tray 59 in a face down state.

On the other hand, in a duplex copy mode, a paper sheet is transported to switch back path 58 similar to the case of the reversal mode. When the rear edge of the paper sheet reaches the reversal point P, roller 54 is switched to reverse rotation. With positions of the front and rear edges reversed, the paper sheet is guided on the left lower face of switching claw 57 to be fed from paper refeed roller 55 to paper refeed path 38. In a composite copy mode, the paper sheet is guided on the left upper face of switching claw 57 to be fed from paper refeed roller 55 to paper refeed path 38.

Figure 2:
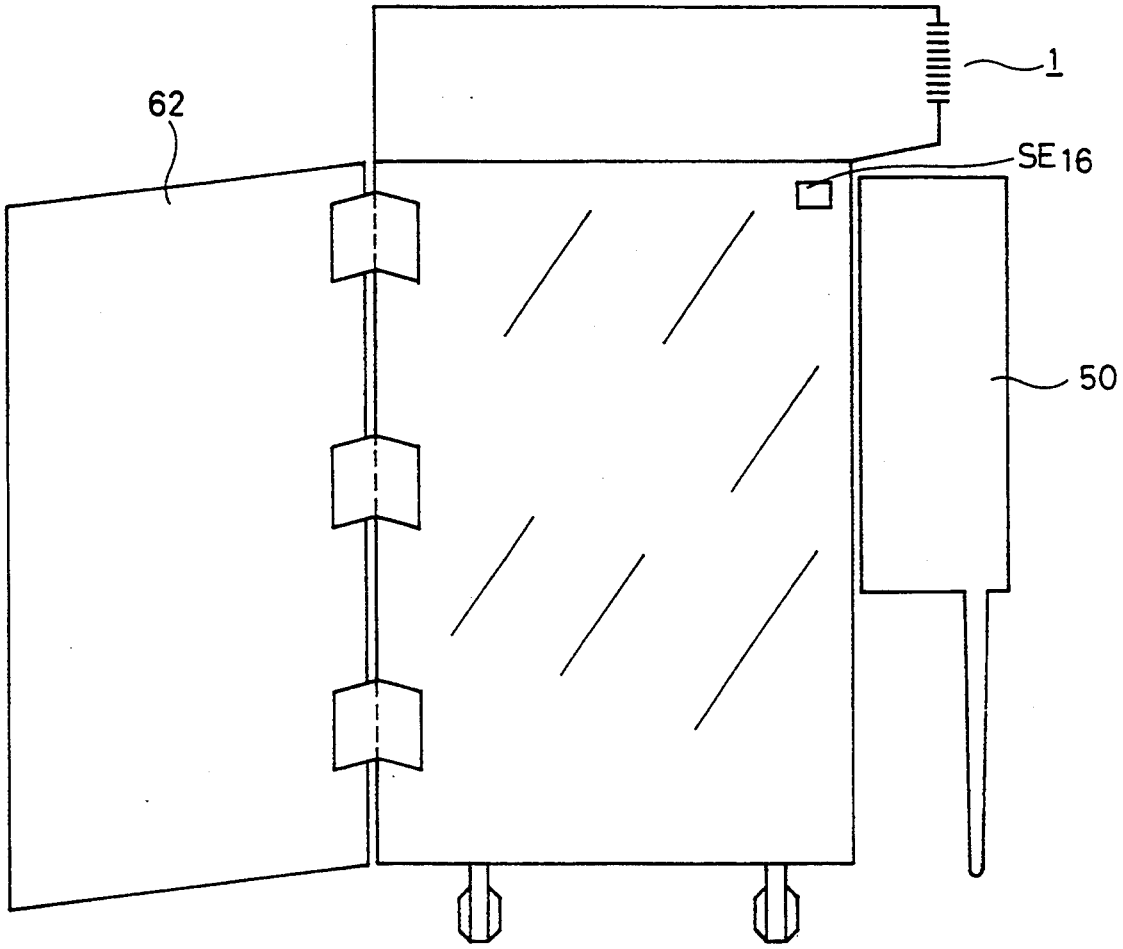
FIG. 2 is a diagram showing an open state of a front cover in the laser printer of FIG. 1.

At the front of laser printer body 1, a front cover 62 is provided as shown in FIG. 2. At least a process cartridge, which will be described later, is excluded from a user by front cover 62. The opening or closure condition of front cover 62 can be detected by a sensor SE16.

Figure 3:
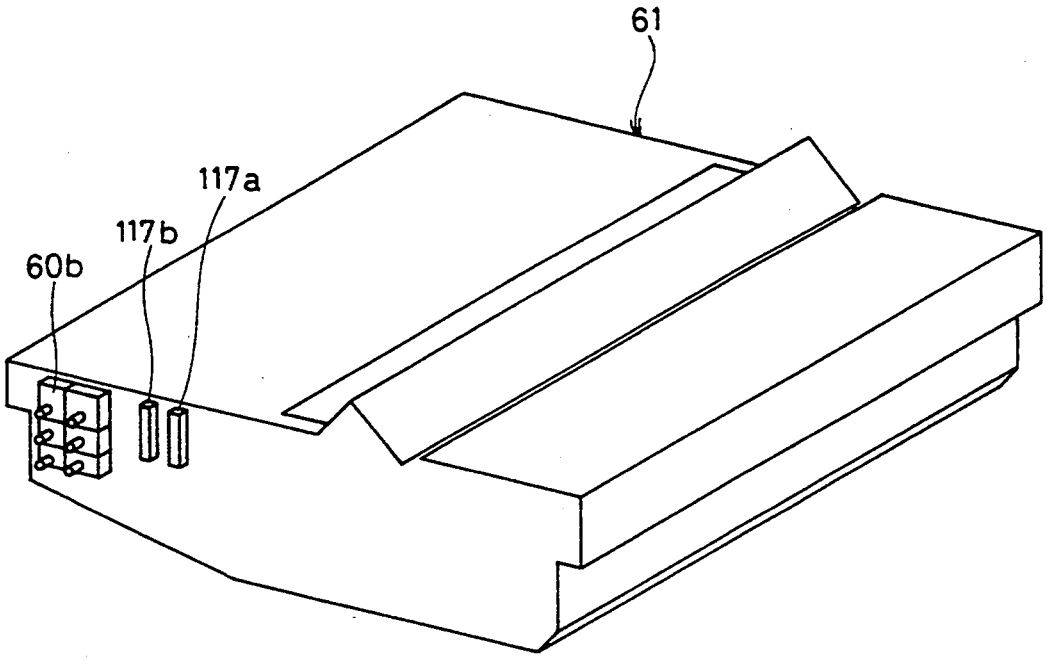
FIG. 3 is a perspective view of an appearance showing a structure of a process cartridge housed in the laser printer of FIG. 1.

FIG. 3 is a perspective view of an appearance of a process cartridge 61 provided to the laser printer body of FIG. 1.

Figure 4:
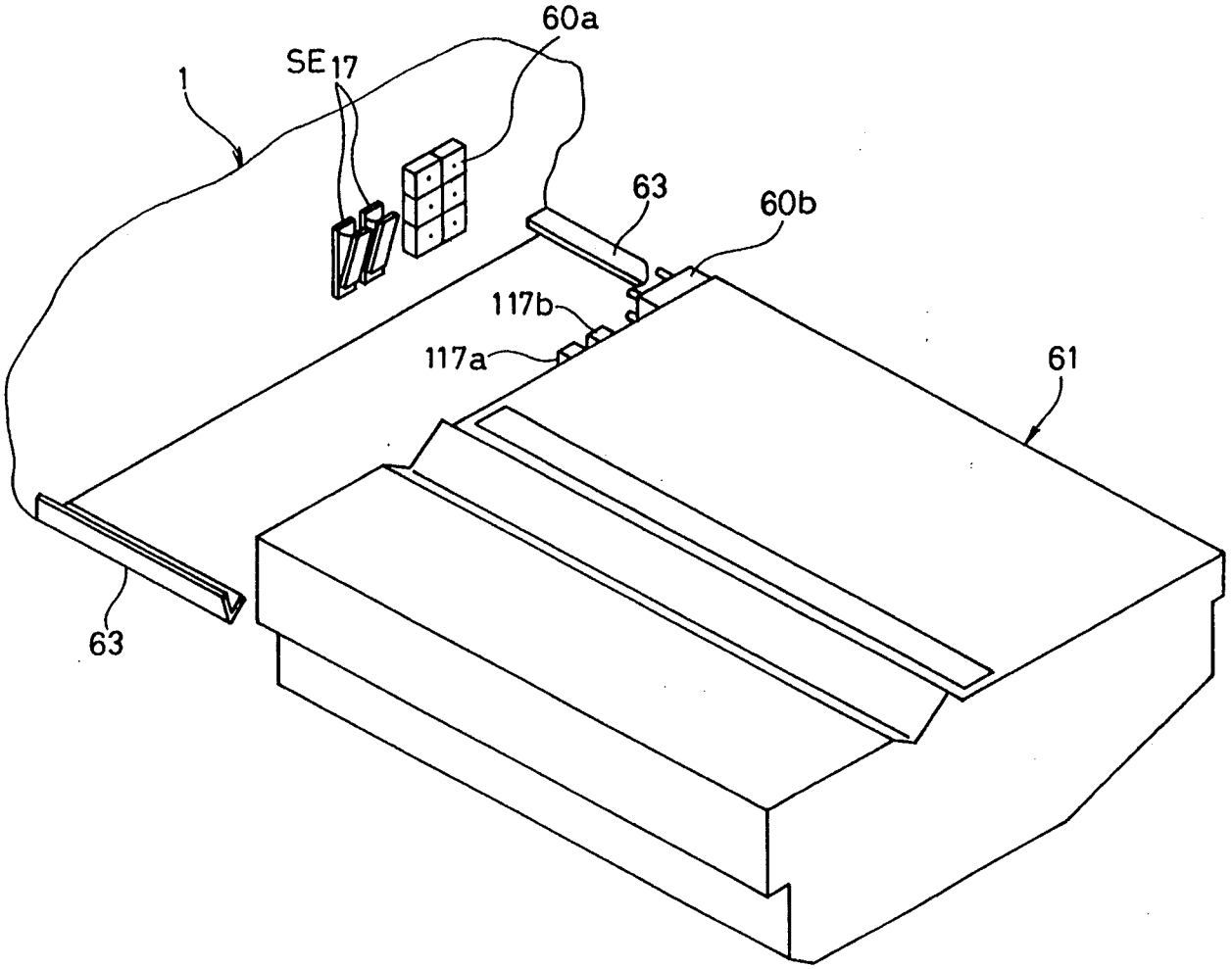
FIG. 4 is a perspective view of an appearance showing a condition where the process cartridge of FIG. 3 is attached/detached to/from the body.

Process cartridge 61 is an integral unification of photoreceptor drum 10, first corona charger 11, first developing device 12, second developing device 14, and cleaning device 16 shown in FIG. 1. An $E^2$PROM which is a non-volatile to be described later is included in process cartridge 61. FIG. 4 is a perspective view showing the state where process cartridge 61 of FIG. 3 is installed to laser printer body 1. The mounting condition of process cartridge 61 to body 1 can be detected by a sensor SE17.

A guide member 63 is used for guidance of attachment/detachment of process cartridge 61 to/from the body.

As shown in FIGS. 3 and 4, a microswitch SE17 serving as a pair of sensors is provided to body 1. Projections 117*a*, 117*b* are provided to process cartridge 61 so as to oppose microswitch SE17. It can be detected by depression of projections 117*a*, 117*b* against microswitch SE17 whether or not process cartridge 61 is mounted to body 1. Data transfer connectors 60*a* and 60*b* are provided to body 1 and process cartridge 61, respectively, to be coupled to each other when process cartridge 61 is mounted to body 1.

Figure 5:
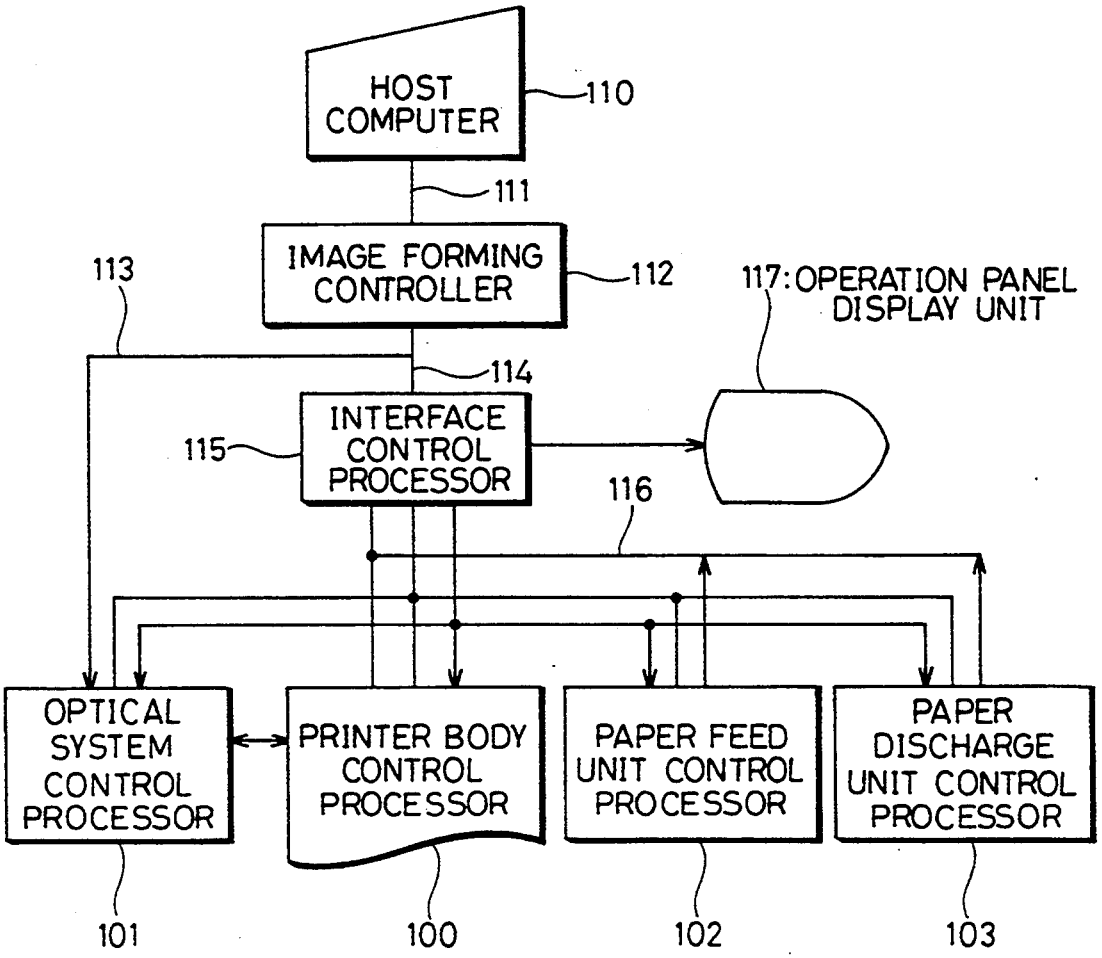
FIG. 5 is a system block diagram showing a configuration of a control circuit of the laser printer of FIG. 1.

FIG. 5 is a block diagram showing a control circuit of the entire system of the laser printer according to the first embodiment of the present invention.

On the side of the printer, included are a control processor 100 controlling the body, a control processor 101 controlling a laser beam optical system, a control processor 102 controlling a paper feed option, if provided, and a control processor 103 controlling a paper discharge option, if provided. Printing information is transmitted to an image forming controller 112 from a host computer 110 via a host interface 111. Image forming controller 112 transmits image information to be printed to an optical system control processor 101 via a video line 113, as well as transmits the print mode to an interface control processor 115 through a control line 114. Interface control processor 115 communicates various modes with each of processors 100 to 103 through a serial interface 116. In addition, interface control processor 115 on/off controls an operation panel display unit 117 on the printer body. Based on instructions from each processor, operation panel display unit 117 indicates the instruction contents to the outside. More specifically, a key is provided on operation panel display unit 117, not shown, which can give instructions to read out the number of uses of process cartridge 61 from an $E^2$PROM to indicate the same. By using this key, the user is informed of the number of uses of process cartridge 61, that is, the lifetime of the cartridge.

Figure 6:
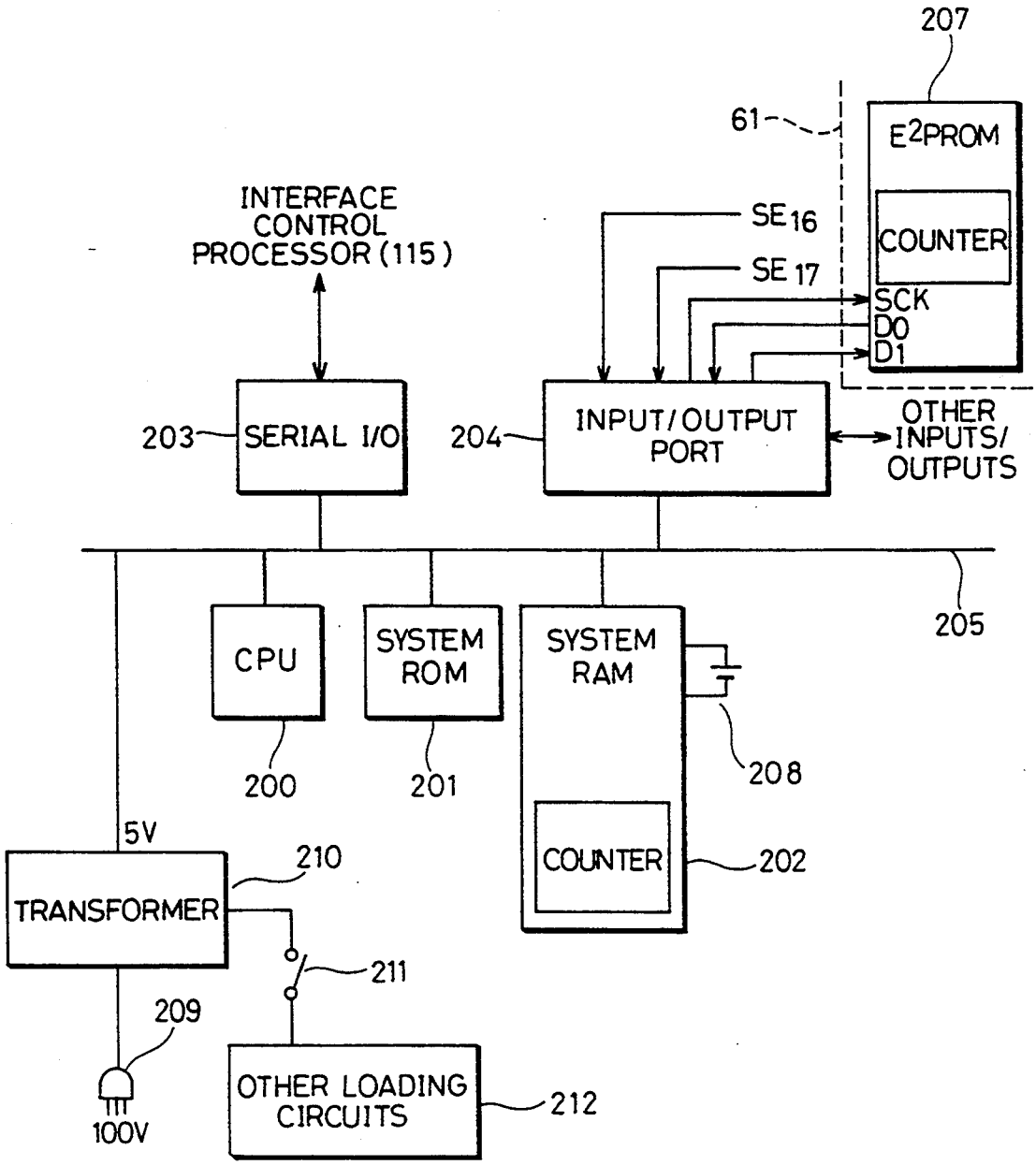
FIG. 6 is a block diagram showing a configuration of a periphery of a printer body control processor.

FIG. 6 is a diagram showing a specific configuration of peripheral circuits of printer body control processor 100 of FIG. 5.

In the figure, a CPU 200, a system ROM 201, a system RAM 202, a serial I/O 203, and an input/output port 204 are connected to a system bus 205. CPU 200 can access system ROM 201, system RAM 202, serial I/O 203, and input/output port 204 through system bus 205. System RAM 202 is backed up by a battery 208 so that the contents of system RAM 202 can be kept even if the power of the laser printer body is turned off. An $E^2$PROM 207 is included in above-described process cartridge 61. CPU 200 can access $E^2$PROM 207 through system bus 205 and input/output port 204. In $E^2$PROM 207, SCK is a clock input terminal, DI is an input terminal of serial data written in $E^2$PROM 207, and DO is an output terminal of serial data transferred from $E^2$PROM 207.

Electric power of a voltage of 5 V is supplied to the above-described circuits by a transformer 210 while a power source plug 209 is connected to a receptacle. More specifically, the control circuits are fed with electricity even when the user turns a main switch 211 off to prohibit feed of electricity to the other loading circuits 212. If a charging circuit is provided, it is possible to always supply electricity to the control circuits even when power source plug 209 is disconnected from the receptacle.

Figure 7:
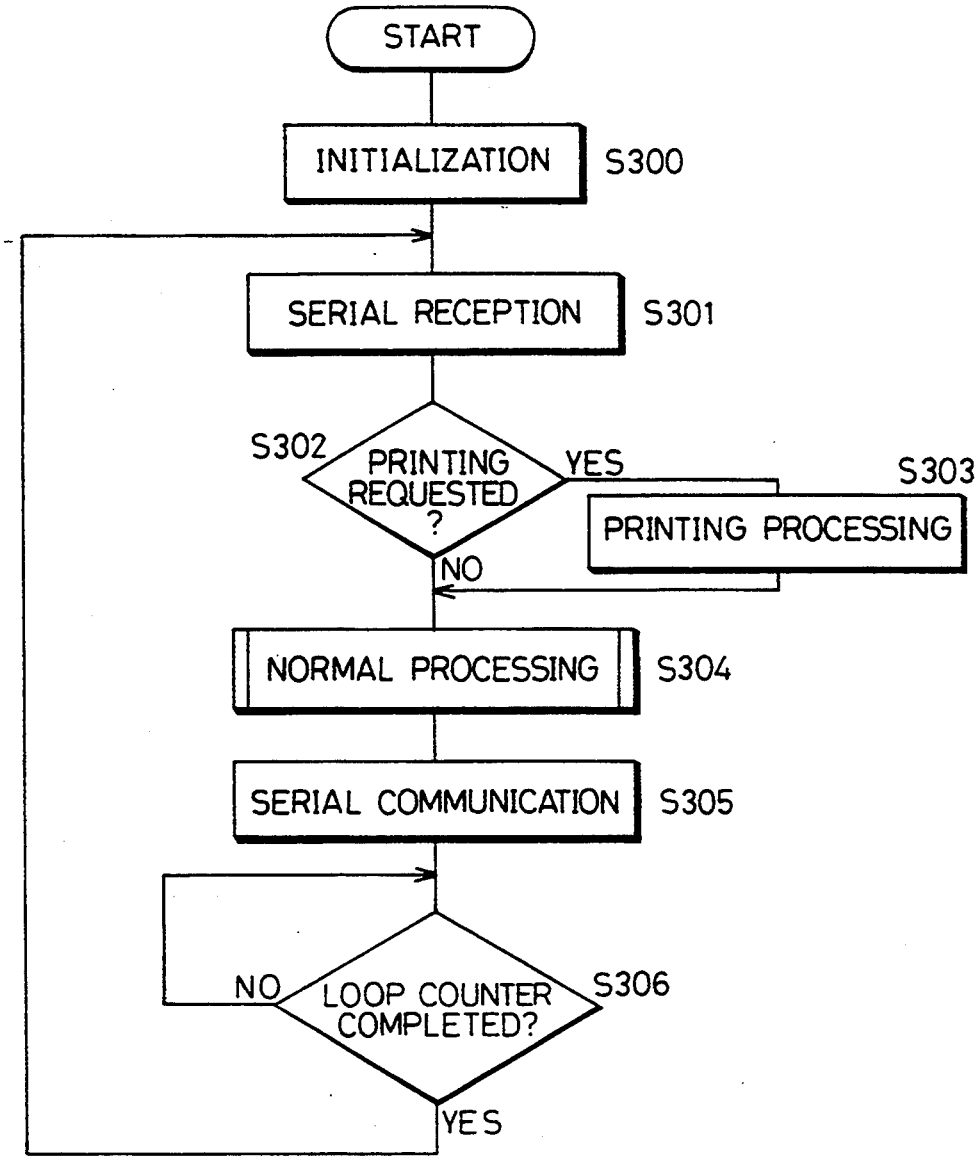
FIG. 7 is a main flow chart showing processing operations of a CPU 200 of FIG. 6.

FIG. 7 is a main flow chart showing processing operations carried out by printer body control processor 100 shown in FIG. 5.

At step S300, the internal RAM and the like are initialized. Then, serial data is received (S301) to set the print mode and a request for printing and the like. It is determined whether or not printing is requested, (S302). When requested, the printing processing (S303) is carried out. Although the contents are not specifically described, for example, warm-up of photoreceptor drum 10 and the peripheral elements thereof, feeding of paper sheets, control of rollers and the like are carried out.

At step S304, the normal processing is carried out. The contents of this processing is carried out irrespective of the state in the print mode or in the printing standby mode. The contents will be described later in detail. Then, by serial communication (S305), information such as printing sequence, the state and the like of the printer body control processor is transmitted to interface control processor 115.

At step S306, counting up of one loop is checked, and the procedure returns to step S301. The similar operation is then repeated.

Figure 8:
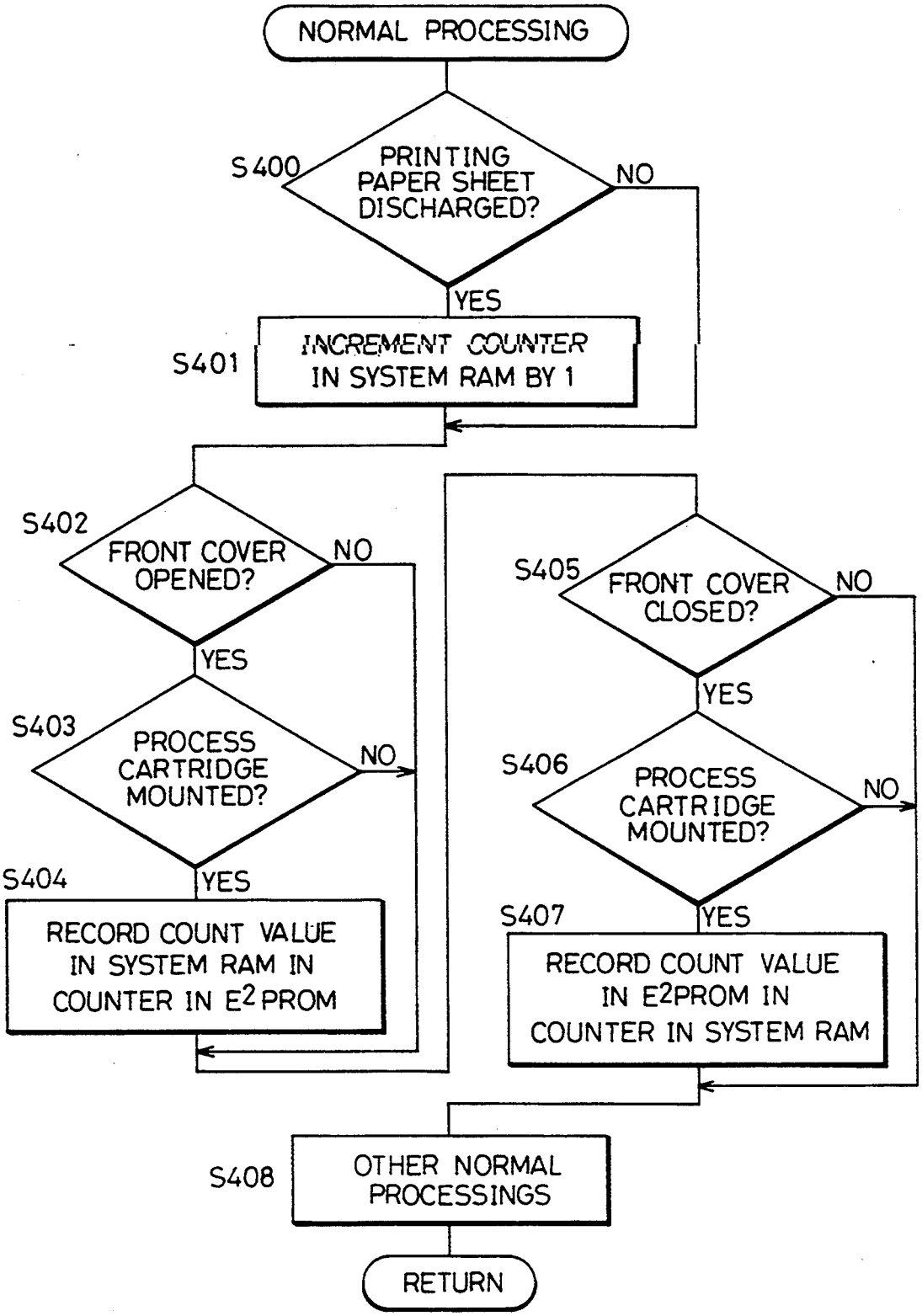
FIG. 8 is a flow chart showing specific contents of a normal processing routine.

FIG. 8 is a flow chart showing specific contents of the normal processing routine of FIG. 7.

At step S400, it is determined whether or not a printing paper sheet is discharged. If discharged, a counter in system RAM 202 is incremented by only one (S401). At step S402, it is determined whether or not the front cover of the printer is opened, based on the output of sensor SE16. If the front cover is opened, at step S403, it is determined whether or not process cartridge 61 is mounted to the printer body, based on the output of sensor SE17. If the process cartridge is mounted to the body, a count value in the system RAM is recorded in a counter in the $E^2$PROM at step S404.

At step S405, it is determined whether or not the front cover of the printer is closed, based on the output of sensor SE16. If the front cover is closed, it is determined whether or not process cartridge 61 is mounted to the printer body, based on the output of sensor SE17 at step S406. If the process cartridge is mounted, a count value in $E^2$PROM 207 is recorded in the counter in system RAM 202 at step S407. This is because, when a used process cartridge is mounted, the lifetime of the process cartridge must be determined based on the count value of the $E^2$PROM included therein plus the number of uses thereafter.

After the above-described processing is completed, the other normal processings are carried out at step S408. Then, the procedure returns to the main routine.

As is clear from description of FIG. 6, electric power of 5 V is supplied to the CPU while the power source plug is connected to a receptacle. Therefore, even if the main switch is turned off, it is possible to carry out detection of opening and closure of the front cover, and writing and reading operations of count data to and from the $E^2$PROM.

Figure 9:
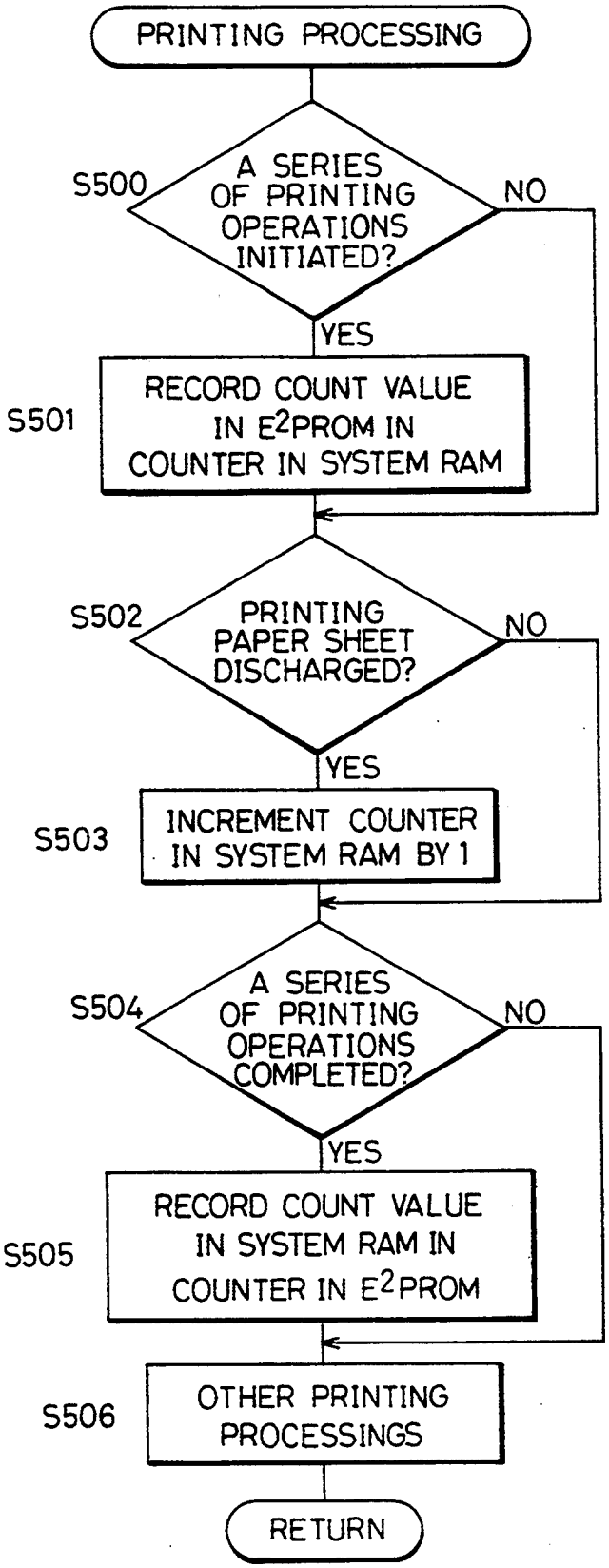
FIG. 9 is a flow chart showing specific contents of a print processing routine according to a second embodiment of the present invention.

In the first embodiment, corresponding count values were recorded from $E^2$PROM 207 to system RAM 202 and from system RAM 202 to $E^2$PROM 207 at a timing of closure of the front cover and at a timing of opening of the front cover, respectively. In place of these timings, by similarly recording count values at timings of initiation and completion of a series of printing operations, the similar effects can be obtained. FIG. 9 shows the specific contents of the printing processing in FIG. 7 in this case, as a second embodiment of the present invention.

Referring to the figure, when the printing processing routine is entered, at step S500, it is determined whether or not a series of printing operations are initiated. If the printing operations are initiated, at step S501, a count value in the $E^2$PROM included in the process cartridge is recorded in the counter in the system RAM of the printer body.

At step S502, it is determined whether or not a printing paper sheet is discharged. If discharged, at step S503, the value of the counter in the system RAM is incremented by one. At step S504, it is determined whether or not a series of printing operations are completed. If the printing operations are completed, at step S505, the count value in the system RAM of the printer body is recorded in the counter in the $E^2$PROM in the process cartridge. Then, after the other printing processings are carried out at step S506, the procedure returns to the main routine.

Figure 10:
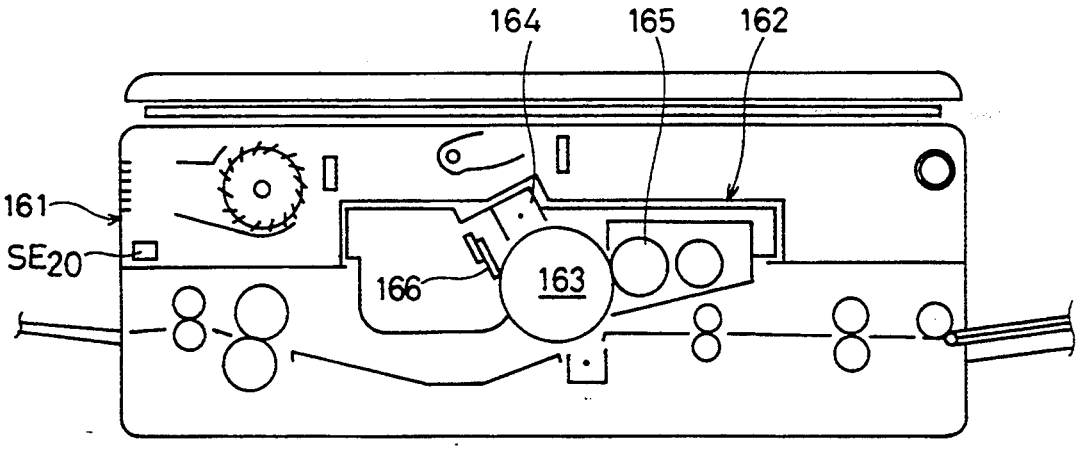
FIG. 10 is a cross sectional view showing a structure of a laser printer of a clamshell system according to a third embodiment of the present invention.
Figure 11:
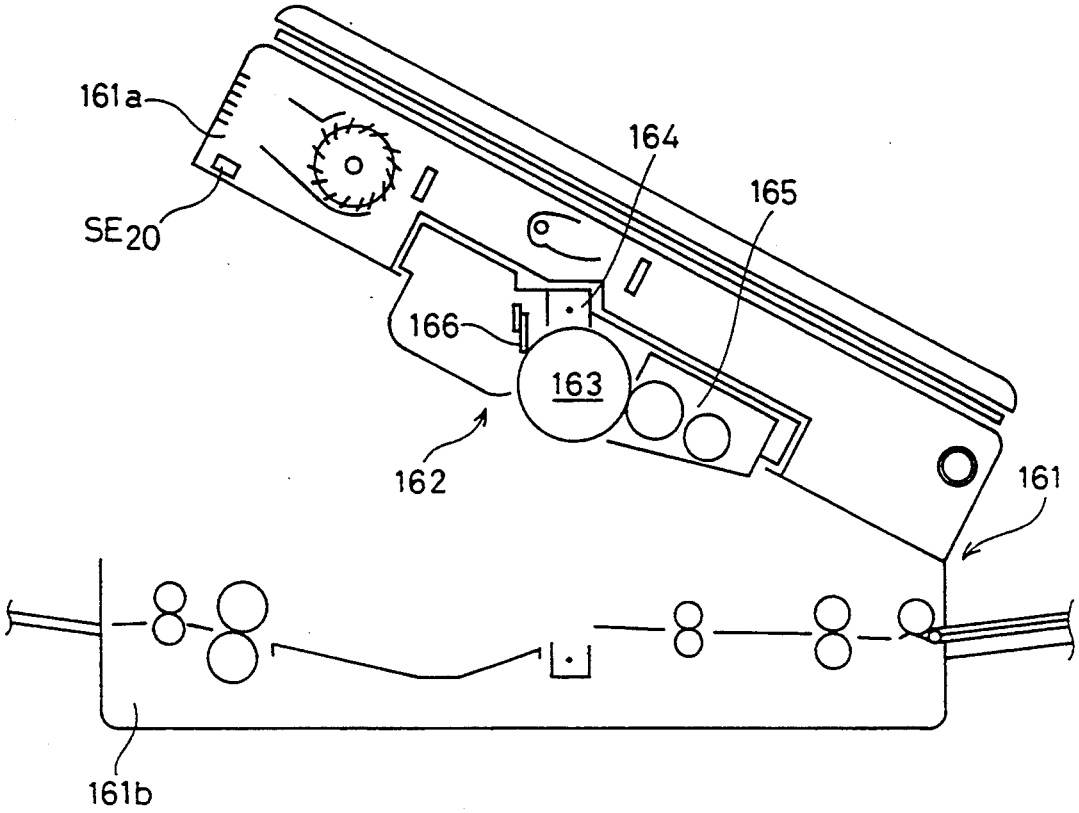
FIG. 11 is a cross sectional view showing a structure when, as a clamshell, an upper portion is opened in the laser printer of FIG. 10.

FIG. 10 is a diagram showing a cross sectional structure of an electrophotographic printer according to a third embodiment of the present invention. FIG. 11 is a cross sectional view in the state where the clamshell system printer of FIG. 10 is opened.

Referring to these figures, in the electrophotographic printer, a clamshell system printer is known for facilitation of maintenance, management, repair and the like. More specifically, an image forming unit 162 integrally unified of a photoreceptor 163, a corona charger 164, a developing unit 165, a cleaner 166 and the like is provided detachably with respect to a body 161. As a clamshell, an upper body 161*a* is opened upwardly with respect to a lower body 161*b* with one side being a support to attach/detach image forming unit 162. A sensor SE20 is provided for sensing opening and closure of the clamshell.

Figure 12:
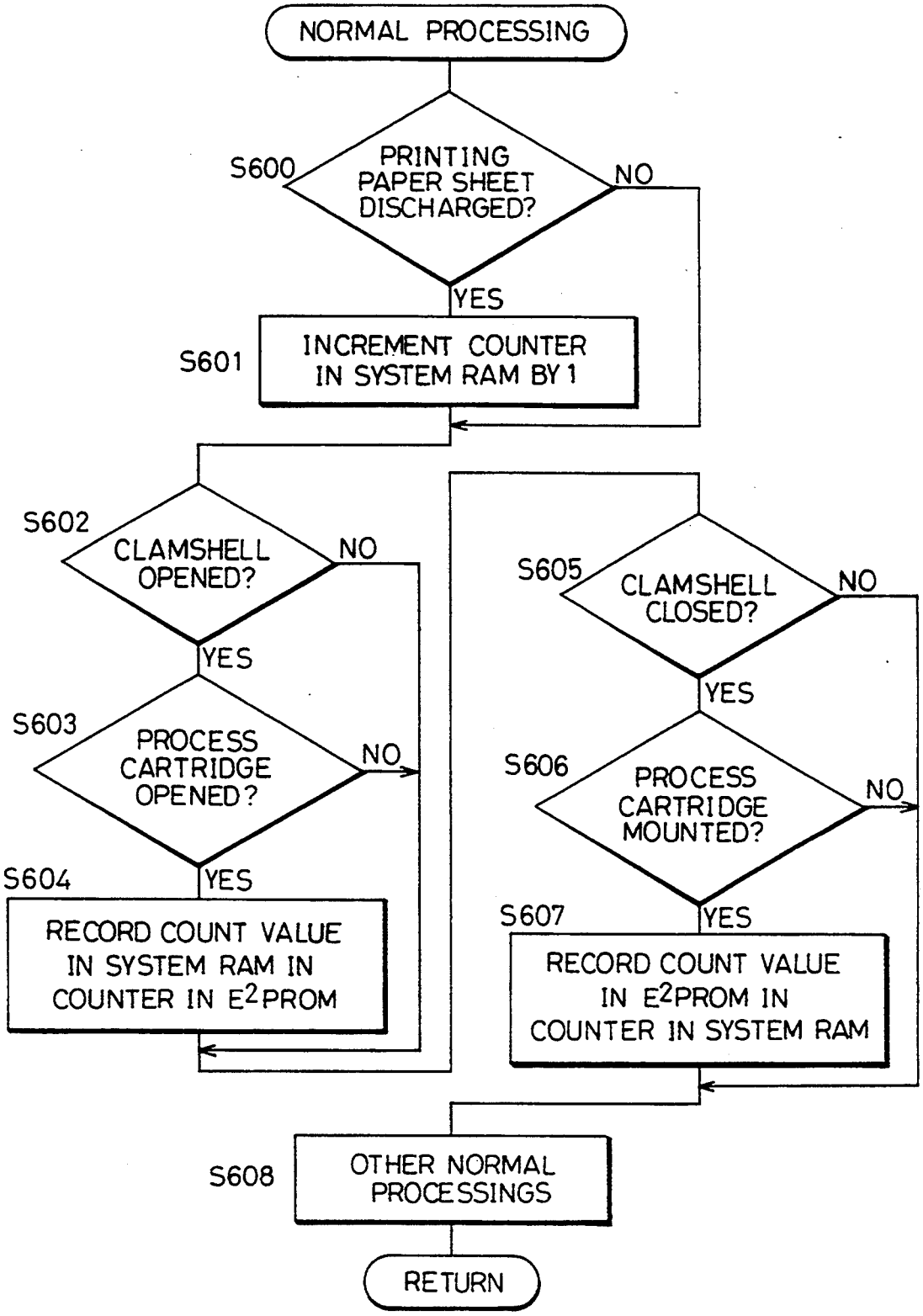
FIG. 12 is a flow chart showing specific contents of a normal processing routine of the laser printer shown in FIG. 10.

FIG. 12 is a flow chart showing the specific contents of the normal processing routine in the printer of FIG. 10.

At step S600, it is determined whether or not a printing paper sheet is discharged. If discharged, at step S601, the value of the counter in the system RAM is incremented by one. At step S602, it is determined whether or not the clamshell is opened based on the output of sensor SE20. In the case where the clamshell is opened and the process cartridge is mounted to the body (Yes at step S603), the count value in the system RAM is recorded in the counter in the $E^2$PROM at step S604.

Then, at step S605, it is determined whether or not the clamshell is closed based on the output of sensor SE20. In the case where the clamshell is closed and the process cartridge is mounted to the printer body (Yes at step S606), the count value in the $E^2$PROM is recorded in the counter in the system RAM at step S607. After carrying out the other normal processings at step S608, the procedure returns to the main routine.

Figure 13:
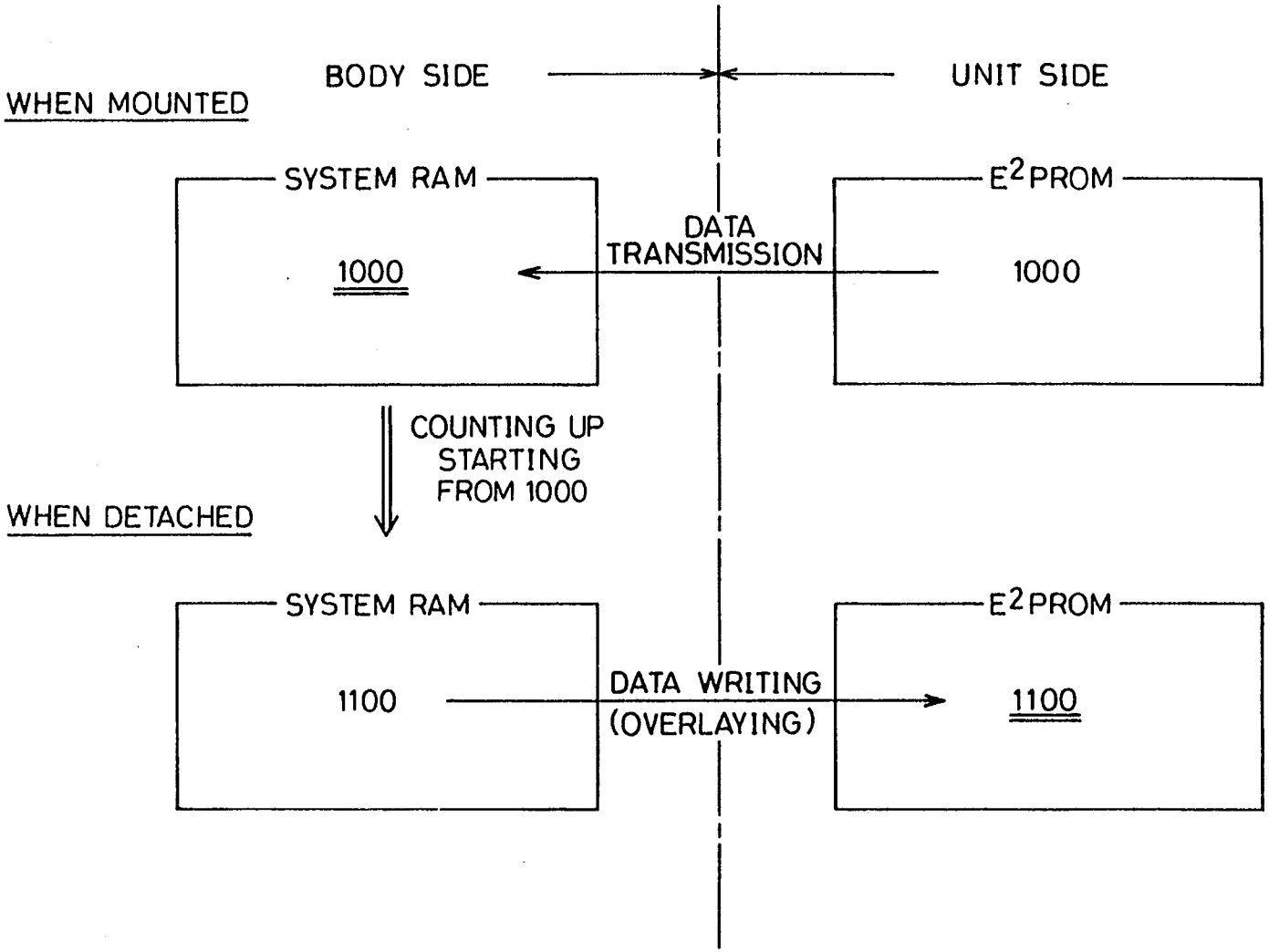
FIG. 13 is a diagram for explaining a delivery method of data in the first to the third embodiments of the present invention.

Description will be given of delivery of data between the system RAM and the $E^2$PROM in the above-described embodiments, with reference to FIG. 13.

Consider the case where the process cartridge which had already been used 1000 times is detached from the body after another 100 times of uses.

In this case, data of the count value of 1000 times stored in the $E^2$PROM on the side of the unit is transmitted to the side of the body when the process cartridge is mounted, to be stored in the system RAM on-the side of the body. The number of count is to be counted up starting from 1000 when the process cartridge is used this time. As a result, after the process cartridge is used 100 times, the value of the counter stored in the system RAM on the side of the body should be 1100. At the time of detachment of the process cartridge, the data is transferred to the $E^2$PROM on the side of the unit to be written instead of the data of the count value of 1000 at the time of mounting. As a result, the value of 1100 is recorded in the counter in the $E^2$PROM.

Figure 14:
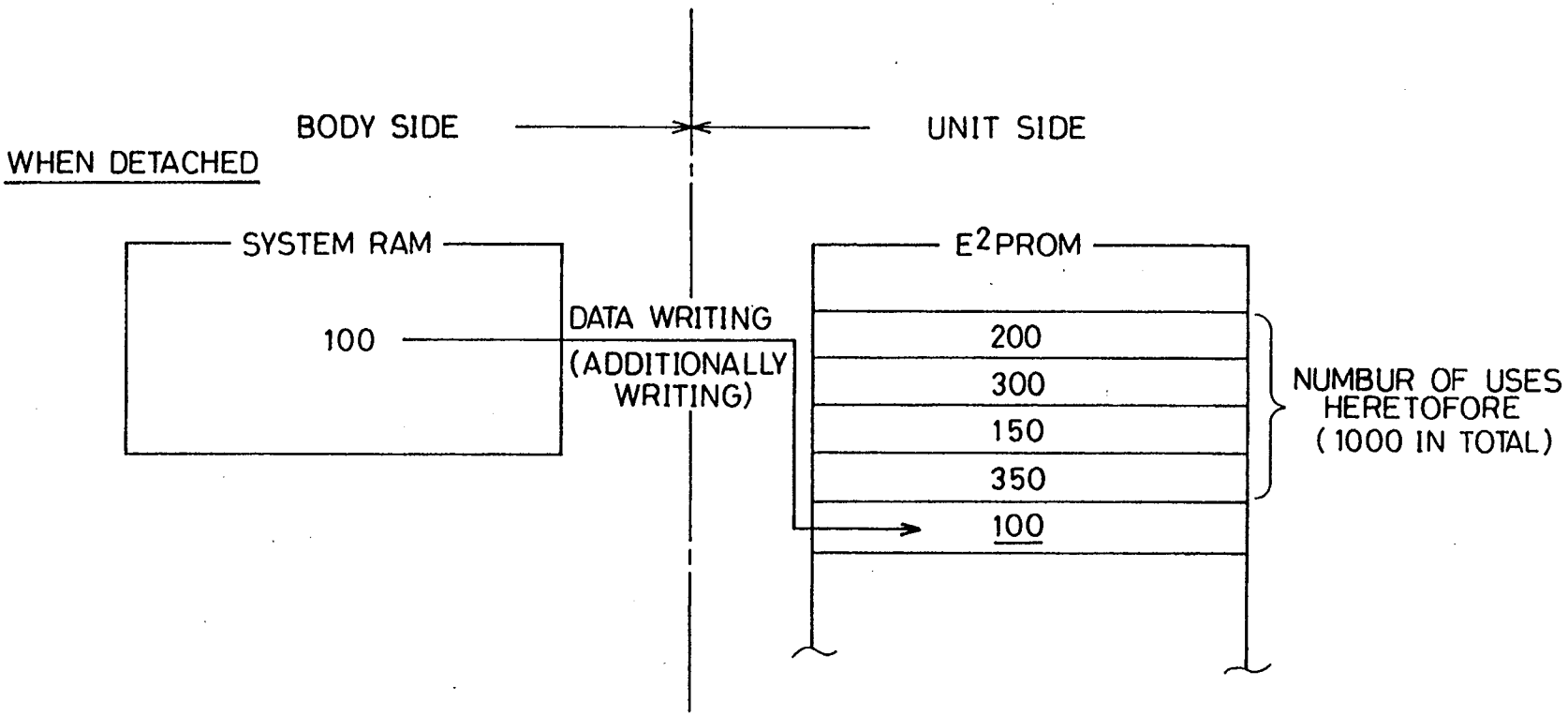
FIG. 14 is a diagram for explaining another delivery method of data different from the delivery method shown in FIG. 13.

Delivery of data is carried out as described above in each embodiment. However, another delivery of data can be considered as shown in FIG. 14.

In this example, unlike the previous example, data stored in the $E^2$PROM on the side of the unit is not transmitted to the system RAM on the side of the body when the process cartridge is mounted to the body. Instead, data stored as the number of uses this time, that is, data of 100, is stored in the system RAM. At the time of detachment of the process cartridge, the data of 100 stored in the system RAM on the side of the body is transferred to the $E^2$PROM on the side of the unit. The data of 100 is additionally written in a region other than regions in which data of 1000 in total has already been stored as the number of uses heretofore. Since the data of 100 written this time is added to the data of 1000 in total heretofore, the data of the number of uses on the side of unit is 1100. Finally, it is possible to determine that the number of uses heretofore is 1100. Delivery of data can also be carried out as described above.

In the above-described embodiments, the example was shown where an $E^2$PROM is provided in a process cartridge. However, the present invention is not limited thereto. An $E^2$PROM may be similarly provided in a consumable unit having its lifetime determined by the number of uses, such as a developing unit and a cleaning unit.

In each of the above embodiments, the present invention was applied to the cases where the front cover is opened, the clamshell is opened and where a series of copying operations are completed. However, the present invention is not limited thereto. For example, the case where the main switch is turned off can also be adopted as a predetermined condition inasmuch, as indicated previously, electric power continues to be supplied to the CPU even when the main switch is turned off. In each of the above cases, the count value is written in the non-volatile memory in response to generation of a predetermined state which has a mean cycle of occurrence which is longer than a mean cycle in which the plurality of elements carry out an image forming operation, thus resulting in a decrease in the frequency of operations of the non-volatile memory.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:

a cartridge holding elements of said image forming apparatus and provided detachably with respect to a body of the apparatus, said cartridge including a non-volatile memory;

a counter counting the number of uses of said cartridge;

detecting means for detecting a preparatory operation for detaching said cartridge from the body of the apparatus;

writing means responsive to a detection output of said detecting means for writing a count value of said counter in said non-volatile memory; and a cover member for covering the body of the apparatus, wherein said detecting means includes means for detecting said cover member being opened.

2. An image forming apparatus comprising:

a cartridge holding elements of said image forming apparatus and provided detachably with respect to a body of the apparatus, said cartridge including a non-volatile memory;

a counter counting the number of uses of said cartridge;

detecting means for detecting a preparatory operation for detaching said cartridge from the body of the apparatus;

writing means responsive to a detection output of said detecting means for writing a count value of said counter in said non-volatile memory, wherein the body of the apparatus can be divided into an upper body and a lower body, and said detecting means includes means for detecting the body of the apparatus being divided into the upper body and the lower body.

3. An image forming apparatus, comprising:

a cartridge holding elements of said image forming apparatus and provided detachably with respect to a body of the apparatus, said cartridge including a non-volatile memory; a counter counting the number of uses of said cartridge;

storing means for storing the number of uses counted by said counter;

a cover member covering the body of the apparatus;

first detecting means for detecting opening and closure of said cover member;

second detecting means for detecting said cartridge being mounted to the body of the apparatus; and writing means for writing in said non-volatile memory the number of uses stored in said storing means when said first detecting means detects said cover member being opened and said second detecting means detects said cartridge being mounted to the body of the apparatus.

4. The image forming apparatus as recited in claim 3, wherein said non-volatile memory includes an electrically erasable and programmable ROM.

5. The image forming apparatus as recited in claim 3, further comprising reading means for reading out the number of uses stored in said non-volatile memory to transfer the same to said storing means when said first detecting means detects said cover member being closed and said second detecting means detects said cartridge being mounted to the body of the apparatus.

6. The image forming apparatus as recited in claim 5, wherein said counter counts up from the number of uses stored in said storing means.

7. The image forming apparatus as recited in claim 6, wherein said writing means additionally overlays the number of uses in a specified region of said non-volatile memory.

8. The image forming apparatus as recited in claim 3, wherein said writing means writes the number of uses in a region of said non-volatile memory where no data has been written yet.

9. The image forming apparatus as recited in claim 3, wherein said cartridge integrally holds a photoreceptor for carrying an electrostatic latent image, and a developing unit for developing the electrostatic latent image.

* * * * *